United States Patent [19]

Trueblood et al.

[11] Patent Number: 4,808,984

[45] Date of Patent: Feb. 28, 1989

[54] GAMMA CORRECTED ANTI-ALIASED GRAPHIC DISPLAY APPARATUS

[75] Inventors: John W. Trueblood, Escondido, Calif.; Masami Mizuno, Tokyo, Japan

[73] Assignee: Sony Corporation, Tokyo, Japan

[21] Appl. No.: 859,634

[22] Filed: May 5, 1986

[51] Int. Cl.[4] ..... G09G 1/14

[52] U.S. Cl. ..... 340/723; 340/728; 340/703; 340/747

[58] Field of Search ..... 340/728, 729, 723, 744, 340/747, 793, 721, 734, 701, 703; 358/140

[56] References Cited

U.S. PATENT DOCUMENTS

| | | | |
|---|---|---|---|
| 4,237,457 | 12/1980 | Houldsworth | 340/728 |
| 4,262,290 | 4/1986 | Vallins | 340/728 |
| 4,470,042 | 9/1984 | Barnich et al. | 340/721 |
| 4,482,893 | 11/1984 | Edelson . | |
| 4,509,043 | 4/1985 | Mossaides | 340/721 |
| 4,586,037 | 4/1986 | Rosener et al. | 340/728 |
| 4,591,844 | 5/1986 | Hickin et al. | 340/728 |
| 4,677,431 | 6/1987 | Lee | 340/728 |

OTHER PUBLICATIONS

IBM Technical Disclosure Bulletin "Anti-aliasing Video Lookup Table" vol. 27, No. 10B Mar. 1985.

Pixel Phasing Smoothes Out Jagged Lines (Anti-Aliasing System For CRTs Uses Four Extra Bit Planes), by David Oakley, Michael E. Jones, Don Parsons, and Greg Burke, Megatek Corp, San Diego, California (Electronics/June 28, 1984).

Jag-Free Images On Raster Displays, by Akira Fujimoto and Kansei Iwata, Graphics Computer Corporation (IEEE Computer Graphics, Dec. 1983).

A High-Speed Algorithm FoOr Generating Anti--Aliased Lines, by R. L. Ketcham of the Mitre Corporation, Bedford, MA (S(D 85 Digest).

*Primary Examiner*—John W. Caldwell, Sr.
*Assistant Examiner*—Jeffery A. Brier
*Attorney, Agent, or Firm*—Philip M. Shaw, Jr.

[57] ABSTRACT

A raster scan display system of the type which includes an anti-aliasing circuit for controlling the pixel brightness to remove the stair-step effect common to raster scan displays, wherein the improvement comprises gamma correction means supplied with the anti-aliased display data for correcting for non-linearity in the relationship between the pixel intensity data and the actual intensity of the corresponding pixel of the raster scan display.

18 Claims, 4 Drawing Sheets

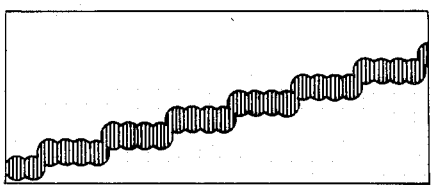
FIG._1A.
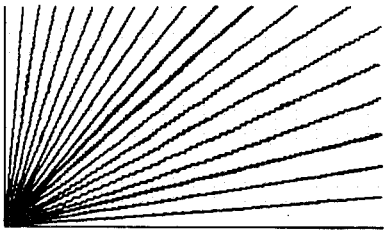
FIG._1B.
ANTI-ALIASING ALGORITHM FLOWCHART
```
REAL: SX, SY, EX, EY,
      VINT, DINT,
      RINT, LINT,
      AUX, SLOPE
INTEGER: RX, RY, LX, LY
INPUT: SX, SY, EX, EY, VINT                    10
RX ← ROUND (SX)
SLOPE ← (EY-SY)/(EX-SX)
AUX ← SLOPE·(RX-SX)+SY
RX ← AUX
DINT ← SLOPE·VINT
LINT ← (AUX-RY)·VINT                           20
    LX ← RX
    LY ← RY+1
    RINT ← VINT-LINT
    OUTPUT: RX, RY, RINT
    LX, LY, LINT
    LINT ← LINT+DINT
    LINT < VINT
    F                T
    RY ← RY+1
    LINT ← LINT-VINT
    RX ← RX+1
    REPEAT UNTIL RX > EX
```
FIG._2.

| | LINEAR INTENSITY | | | GAMMA CORRECTED INTENSITY | | |
|---|---|---|---|---|---|---|
| I | R | G | B | R | G | B |
| 0 | 0 | 0 | 255 | 0 | 0 | 255 |
| 1 | 36 | 18 | 219 | 122 | 94 | 240 |
| 2 | 73 | 36 | 182 | 158 | 122 | 224 |
| 3 | 109 | 54 | 146 | 185 | 142 | 206 |
| 4 | 146 | 73 | 109 | 206 | 158 | 185 |
| 5 | 182 | 91 | 73 | 224 | 172 | 158 |
| 6 | 219 | 109 | 36 | 240 | 184 | 122 |
| 7 | 255 | 127 | 0 | 255 | 195 | 0 |

I IS THE 3-BIT ANTI-ALIASING INTENSITY (0 IS FULL BACKGROUND, 7 IS FULL FOREGROUND)

R, G, B ARE THE 8-BIT RED, GREEN, AND BLUE COMPONENT INTENSITIES LOADED IN THE COLOR LOOK-UP TABLE (RANGE 0-255).

FIG._8.

8 BIT PLANES MAKE UP 1 PIXEL MEMORY LOCATION.

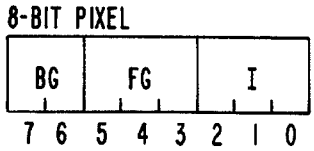

WHERE:

I IS THE ANTI-ALIASING INTENSITY (000 IS FULL BACKGROUND, 111 IS FULL FOREGROUND)

FG IS THE FOREGROUND COLOR SELECTION

BG IS THE BACKGROUND COLOR SELECTION

FIG._9.

GAMMA CORRECTED ANTI-ALIASED GRAPHIC DISPLAY APPARATUS

DESCRIPTION

1. Technical Field

This invention relates to computer generated graphic display systems and, more particularly, to such a system which employs a cathode ray tube display and which has correction to minimize distortion caused by aliasing.

2. Background Art

Picture degradation in raster scan displays caused by aliasing presents the image of "jaggy" or "staircase" appearance of lines and edges. Anti-aliasing techniques have long been known which employ algorithms which vary the intensity of the pixels which are used to display the lines or edges. However, such algorithms are typically criticized for causing line defocusing, brightness uniformity problems, inefficiency of execution, and ineffectiveness for both inverse video and colored vectors against complex backgrounds. In the past, despite the algorithm employed, it has been difficult to produce crisp, straight lines on a raster display taking advantage of raster functions.

Aliasing results from imposing an integer step function (the integer x, y raster coordinates) onto a real function, such as a vector. Any means of anti-aliasing lines, then, is an attempt to draw pixels at fractional coordinates either through an optical illusion using software (such as high spacial frequency filtering) or by physical micro displacement of the electron beam (i.e. pixel phasing).

There are several optical phenomena that are the basis for creating the illusion of fractional pixel coordinates. The most important one in the present application is the integration of light emitted from separate sources in close proximity. By controlling the intensity of, for example, two adjacent pixels, the human eye integrates the light, giving the impression of a single spot whose center is offset toward the brighter of the two spots, and whose intensity is equal to the sum of the intensities of the two spots.

A particularly useful anti-aliasing algorithm was proposed by Fujimoto and Iwata, "Jag-Free Images on Raster Displays," *IEEE Computer Graphics and Applications* (December 1983), pages 26–34. Portions of that article are recreated in this application and the article is incorporated herein by reference.

According to Fujimoto and Iwata, a two-pixel wide Fourier sampling window is imposed on the real vector function to determine the relative brightness of each member of a pixel pair used to approximate a single pixel with fractional coordinates. As Fujimoto and Iwata demonstrated, the brightness calculation can be reduced to a simple, linear, incremental algorithm, thus incurring very little time overhead. The basis of this algorithm will be explained in greater detail further in this application.

Unfortunately, although the proposed anti-aliasing algorithm attempts to correct for aliasing by varying the intensity of pixels as an inverse function from their distance from the center line of the vector or edge, the perceived variation in pixel intensity by the observer does not correlate with the algorithm. This is because there is not a linear relationship between the brightness of the pixel and the intensity information supplied to the display device. Thus, the algorithm does not calculate the individual intensities for each pixel pair according to what the eye actually sees on the cathode ray tube screen.

SUMMARY OF THE INVENTION

The above and other problems which complicate anti-aliasing correction on cathode ray tube displays are overcome by the present invention of a computer generated graphic display system of the type which generates image display data, including data representing the intensity of each pixel of the display, a raster scan graphic display for displaying the image data, and anti-aliasing means wherein the improvement comprises gamma correction means supplied with the anti-aliased display data for correcting for non-linearity in the relationship between the pixel intensity data and the actual intensity of the corresponding pixel of the raster scan display.

In a preferred embodiment, the system includes a color look-up table for storing data representative of a plurality of predetermined colors. The gamma correction means causes the color look-up table to store, for each predetermined color, data representing a plurality of gamma-corrected intensities. In one particular embodiment, the gamma-corrected intensities for each red, green, and blue component of the plurality of colors are stored in the color look-up table as a function of the ratio of the intensity of the foreground color of the display to the intensity of the background color of the display.

In order to allow anti-aliased lines to be displayed on complex backgrounds, the preferred embodiment includes display memory means for storing display data corresponding to each pixel location of the graphic display, with each pixel location being represented by a plurality of lower order bits for storing gamma-corrected intensity data, a plurality of intermediate order bits for storing the color data of either the foreground or the background of the display, and a plurality of higher order bits for storing color data of the background or the foreground of the display. This allocation makes it possible to draw anti-aliased vectors against an existing background using a masked write, thus eliminating the need for a prior read. Where the color of the background information is stored in the higher order bits, by write protecting the higher order bits, each pixel can be automatically anti-aliased to the background present at that pixel location. Masking all but the higher order bits allows the background data to be changed without degradation or recalculation of the anti-aliased foreground. Masking only the intermediate order bits allows an anti-aliased line to be erased cleanly with full restoration of the previous background, thus allowing the animation of anti-aliased objects over a complex background.

It is therefore an object of the present invention to provide a computer generated graphic display which incorporates anti-aliasing and gamma correction for non-linearity of a display means.

It is a further object of the present invention to provide a computer generated, anti-aliased and gamma-corrected display which allows anti-aliased vectors in multiple colors to be drawn on a black background.

It is a yet further object of the present invention to provide a computer generated graphic display which allows inverse video anti-aliasing.

It is yet a further object of the invention to provide a computer generated graphic display which allows the drawing of multi-color vectors anti-aliased to multi-color backgrounds.

Still another object of the invention is to provide a computer generated graphic display which makes it possible to draw anti-aliased vectors against a complex background.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIG. 1A is an enlarged computer drawn simulation of an uncorrected vector as displayed on a raster scan display;

FIG. 1B illustrates a plurality of uncorrected vectors drawn from a common origin as displayed on a 19 inch color monitor;

FIG. 2 is an anti-aliasing algorithm flow chart for a two pixel Fourier window anti-aliasing algorithm for one octant, as developed by Fujimoto and Iwata;

FIG. 8 is a table showing eight gamma-corrected eight-bit intensity values together with the linear intensities for the red, green, and blue components of an orange line anti-aliased to a blue background (for gamma=2.67); and FIG. 9 is an illustration of a bit plane usage for multi-color vector anti-aliasing.

BEST MODE FOR CARRYING OUT THE INVENTION

Figure 3:
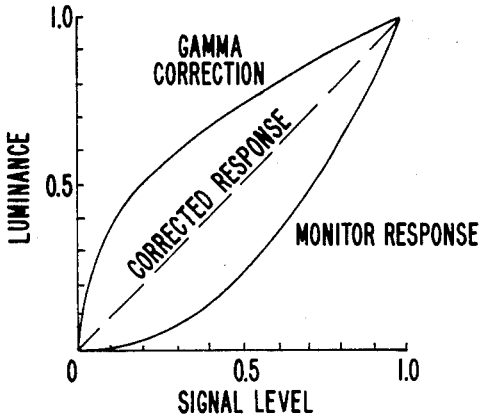
FIG. 3 is a typical gamma correction curve showing the monitor response to increasing signal levels and the gamma correction necessary to produce a linear, corrected response.

An example of the need for anti-aliasing is shown in FIGS. 1A and 1B. Referring to FIG. 1A, an uncorrected line vector as simulated by a computer drawing is illustrated. It will be seen that, if the display attempts to produce the line by evenly illuminating a series of four pixels at different horizontal scan lines in a generally diagonal direction, a jagged line image results. This is best shown in FIG. 1B which is an illustration of a plurality of vector lines radiating from a single point on a monitor.

While the present invention is intended to work with any anti-aliased computer generated raster scan graphic display, the inventor has found that an anti-aliasing algorithm as developed by Fujimoto and Iwata, in the reference described above, is particularly efficient. The anti-aliasing approach adopted by Fujimoto and Iwata is described in the above-referenced article. This specification will only briefly refer to it for purposes of explaining the improvement of the present invention.

The Fujimoto/Iwata algorithm utilizes the special properties of the vector edge, namely, its slope and thickness, which is geometrically equal to zero. The Fourier window is adopted for the spacial filter and the window is assumed to have a value of 1.0 in the region of plus or minus 0.5 of the pixel and a zero everywhere else. In the present implementation, the filter function is normalized so that the enclosed volume is 1. It is also assumed that the size d of the Fourier window is a function of the slope of the vector. For example, the smallest possible window involving shading of one pixel on each side of the vector means that d equals two times the cosine of the angle of the slope of the vector. Each pixel's intensity is obtained by convoluting the filter function and the line intensity. Each pixel intensity is inversely proportional to the distance from the center line of the vector, that is:

$$C' = C(d - 2dx)/d$$

where $C'$ = intensity of pixel under consideration;

$C$ = overall vector intensity;

$dx$ = distance between pixel and vector center line;

$d$ = fourier window size = 2(cosine of slope of vector)

The intensity of the pixel as it approaches the center line of the vector will converge to the overall vector intensity. If the thickness of the vector is assumed to be finite, then this property is satisfied only when the size of the filter function is equal to or less than the thickness of the vector.

In producing a jag-free vector that is as thin as possible, the thickness of the displayed vector is limited by the smallest possible size of the Fourier window. When generating a pixel on one side of the vector, one must ensure that its counterpart exists on the other side of the vector. This sets a limit on the window size for a vector with a given slope as described above. The intensity of each pixel is a linear function of its distance from the center line of the vector, as mentioned above, and thus the principle of superposition can be applied, and the intensity of each pixel can be calculated incrementally without explicit calculation of this distance.

Figure 4A:
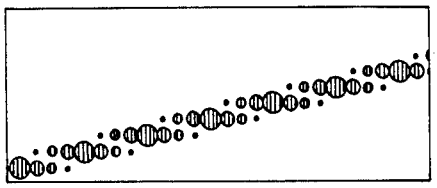
FIG. 4A is an enlarged computer simulation of one anti-aliased vector line as displayed on a raster scan display.

FIG. 4A illustrates a computer simulation of a vector line on a raster scan display after it has been processed by the Fujimoto/Iwata algorithm. It will be noted that the pixels lying along the center line have the maximum intensity with the pixels which are located further and further away from the center line having decreasing intensity.

A flow chart of the Fujimoto/Iwata algorithm is shown in FIG. 2. The logic shown is for a Fortran program and is restricted to the vectors in the first octant (i.e., $0<y<x$); the extension to other regions being obvious. Note that in anti-aliasing schemes, one must use whichever value of the pixel coordinates (x, y) is changing the most often. Thus, in anti-aliasing schemes of this type, it is necessary to divide the screen into eight sectors or octants.

In the flow chart, the variable names RX, RY and RINT are related to the current write pixel coordinates and the intensity of the pixels, respectively. The variables LX, LY, and LINT refer to the left pixel coordinates and their intensity. The inputs SX, SY, EX, EY, and VINT refer to the coordinates of the starting and ending pixels of the vectors and the vector intensity. Note that the intensity in this program is the incremental accumulator and that the pixel coordinates are the byproducts of the iteration counters.

The algorithm has an initialization section 10 which precedes the main body 20 of the procedure. This initialization section 10 provides for subpixel addressability in that it allows one to place the end points of the vector between the pixels. A pixel's coordinate and intensity are simultaneously generated in the main part 20 of the algorithm. It is the pixels' intensity control variable LINT that directly governs the generation of the coordinates. The control variable simultaneously incorporates both physical and geometrical meanings.

As mentioned above, the net result of the Fujimoto/Iwata anti-aliasing algorithm produces pixel intensity data which determines how bright each pixel on the display screen is to be for displaying a particular vector or edge. However, as explained above, this digital data cannot be directly converted to an analog voltage and applied to the cathode ray tube gun to produce a corresponding linear increase or decrease in the intensity of the pixel. The reason for this is that the relationship between the cathode current of the cathode ray tube and the amount of light produced by the phosphor in a given CRT is not linear.

Figure 4B:
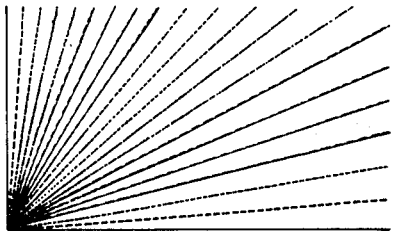
FIG. 4B illustrates a plurality of radially diverging, anti-aliased vector lines as displayed on a 19 inch color monitor.

FIG. 3 illustrates a typical gamma correction plot. For increasing signal level, that is, digital pixel intensity data and hence cathode current, the luminance does not increase in a linear fashion. If this linear intensity data is corrected according to the gamma correction curve, the net result is a linear, corrected response, as illustrated by the dashed line in the figure. FIGS. 4A and 4B show the "twisted rope" uniformity problem and ineffective straightening which results from failing to correct for gamma even though the anti-aliasing algorithm has been applied.

Accurate gray scale selection is imperative in the effectiveness of the anti-aliasing illusion. The algorithm cannot stop with the linear brightness relationship arrived at through the incremental or distance calculation approach of Fujimoto/Iwata. Rather, the algorithm must produce pixel intensities according to what the human eye perceives. Therefore, the algorithm must account for the relationship between digital values presented in the digital to analog controller (DAC) of the signal generator used to produce the display and the resulting brightness appearing on the cathode ray tube. In other words, to achieve the maximum effect of the anti-aliasing illusion, the algorithm must calculate the individual intensities for each pixel pair according to what the eye will see on the display screen.

Gamma is the characteristic that mathematically describes the relationship between the cathode current density and the amount of light produced by the phosphor in a given CRT of the display. It is defined by the following formula:

$$B = kE^{1/\gamma}$$

Where

B = the gamma corrected digital brightness of the pixel value to store in the color look-up table K = a constant equal to the maximum digital brightness value (255 for an 8-bit DAC)

E = the desired linear brightness such that $0 \leqq E \leqq 1$ $\gamma$ = gamma E is described as follows:

$$\frac{(\text{pixel value} - \text{pixel minimum})}{(\text{pixel maximum} - \text{pixel minimum})}$$

for a pixel value continuum where the "pixel minimum" is the pixel value corresponding to zero brightness, "pixel maximum" is the pixel value corresponding to full brightness, "pixel value" is the linear pixel value in question that falls within the given continuum.

For the monitor used during the algorithm development, a gamma value of 2.67 was experimentally determined as the optimum for anti-aliasing. This gamma value has remained constant for all production units of that monitor model (Sony GDM-1901) tested over a span of 1.5 years. One additional benefit of proper gamma compensation is the same gamma correction function can be applied to accurate color mixing that is continuous throughout the gray scale. This allows simple shading of objects in the display without changing the apparent color mix (i.e. orange does not look reddish for dark shades but rather looks like dark orange.

Figure 5A:
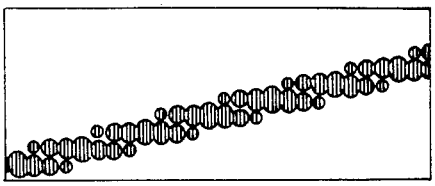
FIG. 5A is an enlarged computer simulation of a gamma-corrected, anti-aliased vector line as displayed on a raster scan display.
Figure 5B:
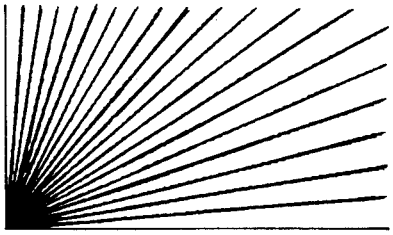
FIG. 5B is a drawing illustrating a plurality of radially diverging gamma-corrected, anti-aliased vector lines as displayed on a 19 inch color monitor.

The effect of gamma correction of anti-aliased display data is illustrated in FIGS. 5A and 5B. Effective gamma correction produces smooth lines with good uniformity at very nearly the same line width as raw vectors on a stroke display.

Figure 6:
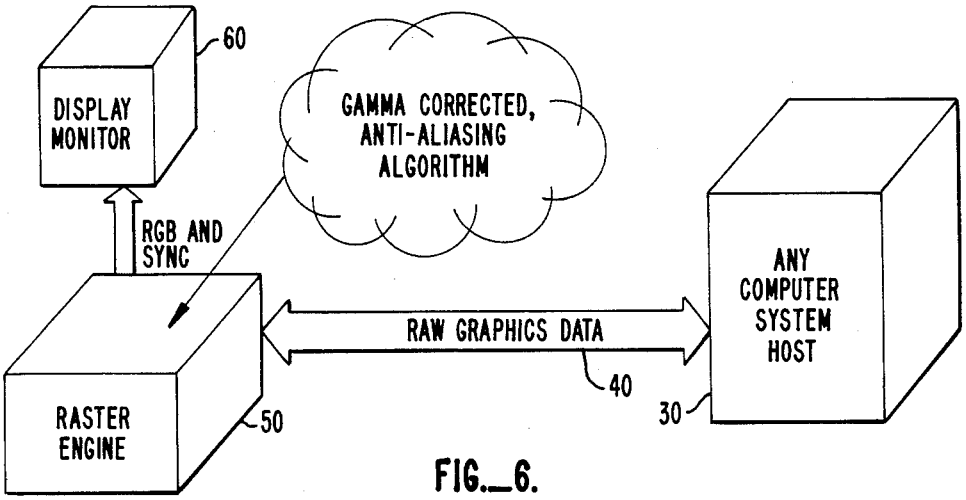
FIG. 6 is a block diagram illustrating the environment of the present invention.
Figure 7:
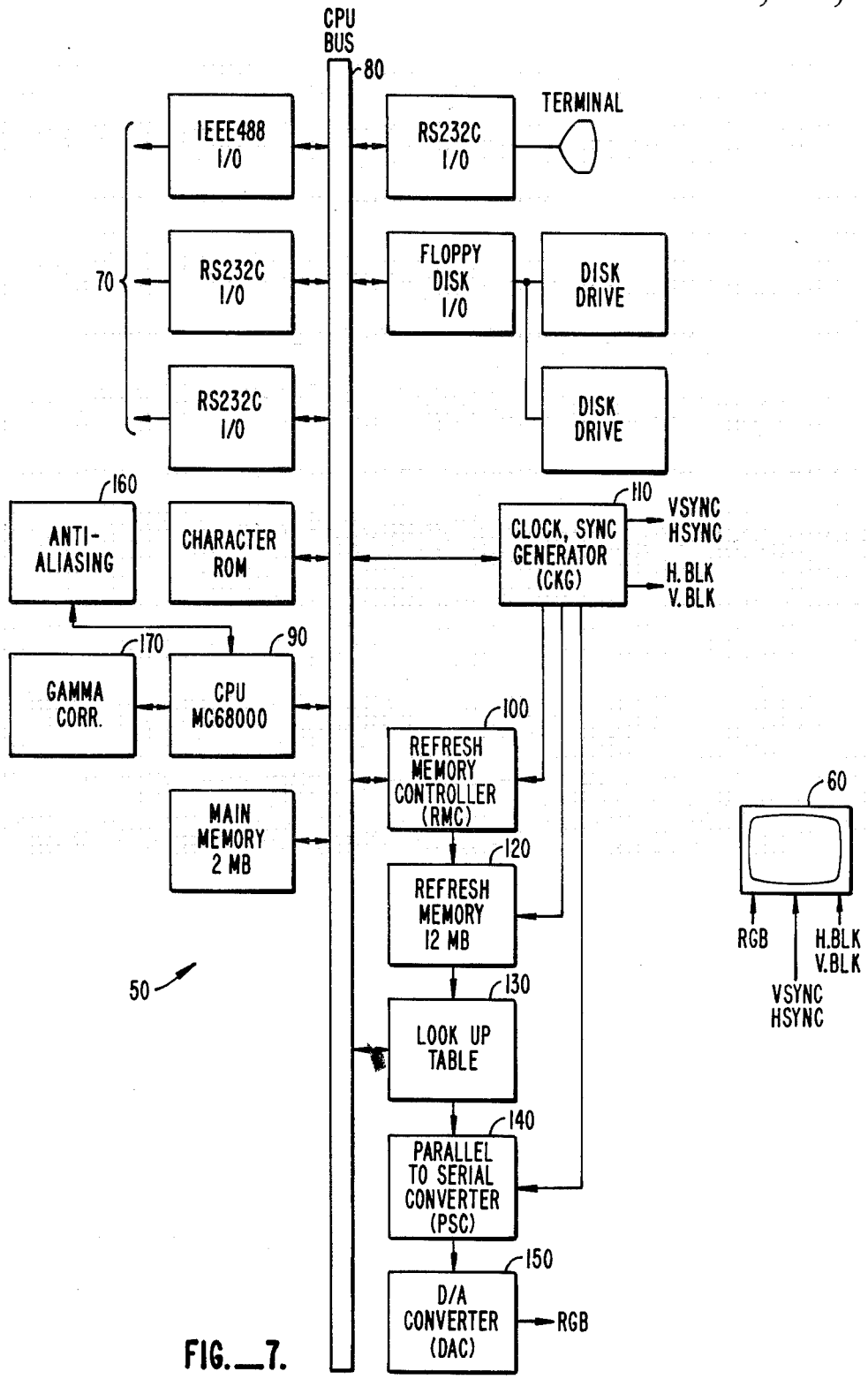
FIG. 7 is a block diagram of the raster engine depicted in FIG. 6.

Referring now to FIG. 6, a block diagram of a system which incorporates the present invention is illustrated. In this system, a host computer 30 transfers raw graphic data 40 via a bus or other communications interface to a raster engine 50 which produces RGB and sync signals for a display monitor 60. The raster engine can be any type of signal generator for a CRT display. One such raster engine is depicted in FIG. 7. Since the operation of the raster engine should be well understood by those skilled in the art and in and of itself forms no part of the invention, it will not be described in detail.

Suffice to say that the raw graphics data is received by the raster engine 50 through one of the many input-/output devices labeled generally 70 in FIG. 7. This data is passed along a CPU bus 80 to the CPU 90 which processes the data and supplies it to a refresh memory controller 100 and a clock sync generator 110 which produces the vertical sync (Vsync), horizontal sync (Hsync), horizontal blanking (H.BLK), and vertical blanking (V.BLK) signals for the display monitor 60, as well as synchronizing the operation of the refresh memory controller 100.

The refresh memory controller 100 loads the data into a refresh memory unit 120 which includes a bit mapped memory for the display screen of monitor 60. The output of the refresh memory 120 is fed to a look-up table 130, whose function will described in greater detail hereinafter, which produces the digital display data in parallel form to a parallel to serial converter 140. Under the control of the clock sync generator 110, the parallel to serial converter 140 supplies display data in serial form to a D-to-A converter 150 which produces the RGB signals for the monitor 60.

The CPU 90 has access to the anti-aliasing program 160 and a gamma correction program 170 which are shown in separate blocks in the figure. The anti-aliasing program is preferably the Fujimoto/Iwata algorithm shown in FIG. 2. It will be understood, however, that these programs are simply stored in ROM or can be loaded in through the input-output devices 70. As will be explained in greater detail hereinafter, in supplying the refresh memory controller with the display data, the CPU executes the anti-aliasing algorithm of Fujimoto/Iwata and supplies anti-aliased pixel intensity data to the refresh memory 120. Gamma correction, however, is provided by loading the look-up table 130 with gamma corrected intensity values.

Because non-linear functions are time consuming to calculate, the gamma correction is much more efficiently performed in the initial loading of the color look-up table 130 rather than in performing in real time the calculation shown above. Assuming an 8-bit color map in the color look-up table 130, three bits may be assigned for anti-aliasing information and the remaining five bits may be used to define up to 32 different vector colors. The CPU loads the color look-up table 130 with 32 programmatically defined colors corresponding to the high order five bits of the color map. Then, for each of these vector colors, eight gamma corrected intensities are calculated and loaded into the color look-up table 130 by adding the three bit intensity value to the five upper bit color values to form the eight bit color map entry number. For the three bit binary intensity, 000 represents zero intensity, 111 represents full intensity, and the steps inbetween are the gamma-corrected intensities. When the CPU performs a vector draw, the anti-aliasing routine 160 shifts the color value three bits to the left, then for each calculated pixel, inclusive OR's the proper three bit intensity producing the eight bit pixel value. The result is multicolor anti-aliased vectors on a black background.

Inverse video anti-aliasing results directly from the gamma-corrected color look-up table 130. The CPU 90 first sets the background to the desired color and sets a software flag indicating that inverse video vectors are to be drawn. When the anti-aliasing routine 160 calculates the pixel intensity, the three bit value is exclusive OR'ed with $111_2$ (effectively subtracting the intensity from the maximum value). This inverts the intensity level within the gamma correction. The result is anti-aliased black lines on a solid color background. Using the multicolor vector color map, up to 32 background colors may be used in one screen of the monitor 60 with black anti-aliased vectors appearing in each background region. The resulting line width obtained is dependent upon the rise and fall times and bandwidth of the video amplifier of the monitor (not shown).

To enable anti-aliased raster operation such as solid background and filled polygons it is necessary to be able to draw multicolor vectors anti-aliased to multicolor backgrounds. This can be done in the color look-up table loading routine without any changes to the anti-aliasing algorithm itself.

The basic concept is to blend each vector color to a background color instead of blending the vector color to black. This blending must be gamma-corrected and continuous in both directions so the inverse video capability can reverse the colors, thus doubling the number of color combinations.

The first step is to define the RGB intensities for the foreground and the background of each of the vector colors. Next, an array of gamma-corrected color intensities is calculated to simplify the proper color look-up table values with intensity subranges (for gamma-corrected intensities of partial bright colors). Next, eight linear intensity values are calculated as even increments from foreground to background for each RGB component of each vector color. This is illustrated in FIG. 8 which depicts the content of the look-up table for the example of gamma-corrected RGB intensities for orange lines anti-aliased to a blue background. Each of the linear intensity values is used as a subscript into the gamma correction table to find the proper gamma-corrected value for that intensity, which is then stored in the color look-up table 130. By using this method, inverse video is defined as exchanging the foreground color with that of the background. For the table shown in FIG. 8, a gamma value of 2.67 was used. It should be understood, however, that the gamma value depends on the particular monitor. Typical values of gamma range from 2.3 to 2.8 for color monitors.

Referring now more particular to FIG. 9, using the bit plane definition shown in the figure, allows anti-aliased lines to be easily drawn on complex backgrounds. For example, an anti-aliased vector can be drawn against an existing background using a masked write, thus eliminating the need for a prior read. Write protecting bits 6 and 7 will protect the background information. Each pixel will then be automatically anti-aliased to the background color present at that pixel location. Masking bits 0 through 5 allows the background data to be changed without degradation or recalculation of the anti-aliased foreground. Masking bits 3 through 7 allow an anti-aliased line to be erased cleanly with full restoration of the previous background, thus allowing the animation of anti-aliased objects over a complex background. This bit plane definition represents the organization of the refresh memory 120.

In short, using this method effectively treats complex backgrounds the same as black. The background complexity has no effect on drawing time or effectiveness of anti-aliasing. Both foreground and background data are independently changeable.

If, however, in a raster engine other than that depicted in FIG. 7 is used which does not allow masked writes, then one must use the less efficient read-modify-write procedure in order to preserve the background data. In fact, if animation over a background is desired requiring background restoration, the full write/erase cycle consists of read-store-modify-write-recall-write; as opposed to mask write-mask write for a maskable bit plane architecture. Therefore, maskable bit plane-write enable is an important for efficiency in the signal generator when utilizing this technique.

Although the present invention has been shown and described with respect to preferred embodiments, various changes and modifications which are obvious to a person skilled in the art to which the invention pertains are deemed to lie within the spirit and scope of the invention.

We claim:

1. In a computer generated graphic display system of the type which generates image display data of a colored vector on a colored background, including data representing the intensity of each pixel of the display, a raster scan graphic display for displaying the image data, and anti-aliasing means for controlling the brightness of each displayed pixel to smooth out "stair-step" effects inherent in raster scan graphic displays, the improvement comprising gamma correction means supplied with the anti-aliased display data of the colored vector for correcting for non-linearity in the relationship between the pixel intensity data and the actual intensity of the corresponding pixel of the raster scan display independently of the background color.

2. In a computer generated graphic display system of the type which generates anti-aliased image display data for display on a raster scan graphic display and which includes a color look-up table for storing data representative of a plurality of predetermined colors, the improvement comprising gamma correction means for generating data representing a plurality of gamma-corrected intensities for each red, green, and blue component of the plurality of colors and wherein said color look-up table stores such data as a function of the ratio of the intensity of the foreground color of the display to the intensity of the background color of the display, and wherein said plurality of intensities are located within the color look-up table as a function of the anti-aliasing value corresponding to the calculated intensity value such that a linear relationship exists between successive anti-aliasing values and successive intermediated colors progressing from background to foreground as the colors appear on a raster scan graphic display, whereby independence between anti-aliased foreground image data and existing background image dated is facilitated.

3. The computer generated graphic display system as recited in claim 2 further comprising display memory means for storing display data corresponding to each pixel location of the graphic display, with each pixel location being represented by a plurality of intermediate order bits for storing the color data of the foreground of the display, a plurality of higher order bits for storing color data of the background of the display, and a plurality of lower order bits for storing anti-aliased intensity data which modifies the resulting pixel color appearing on the display to a value inclusively between said foreground and said background color values individually for each pixel location within said display memory.

4. A computer generated graphic display system as recited in claims 1 or 2 wherein the anti-aliasing means uses a two pixel wide Fourier window anti-aliasing algorithm.

5. A computer generated graphic display system as recited in claim 4 wherein the anti-aliasing means causes the intensity (C') of each pixel used to display a vector on the display means to be inversely proportional to the pixel's distance from the vector according to the formula:

$$C' = C(d-2dx)/d$$

where:

dx = distance between the pixel and the center line of the vector d = 2(cosine of vector slope angle)

C = overall intensity of displayed vector.

6. A computer generated graphic display system as recited in claims 1 or 2 wherein the gamma correction means causes the generation of intensity data for each pixel according to the formula:

$$B = kE^{1/\gamma}$$

where:

B = the gamma corrected digital brightness of the pixel value

K = a constant equal to the maximum digital brightness value

E = (Pv − Pmn)/(Pmx − Pmn)

Pv = linear pixel intensity value in question

Pmn = pixel intensity value corresponding to zero brightness

Pmx = pixel intensity value at maximum brightness $\gamma$ = gamma correction constant for the particular model of the raster scan graphic display.

7. The computer generated graphic display system as recited in claim 2 further comprising display memory means for storing display data corresponding to each pixel location of the graphic display, with each pixel location being represented by a plurality of intermediate order bits for storing the color data of the background of the display, a plurality of higher order bits for storing color data of the foreground of the display, and a plurality of lower order bits for storing anti-aliased intensity data which modifies the resulting pixel color appearing on the display to a value inclusively between said foreground and said background color values individually for each pixel location within said display memory.

8. The computer generated graphic display system as recited in claim 2 wherein the raster scan graphic display has an implied background color and further comprising display memory means for storing display data corresponding to each pixel location of the graphic display, with each pixel location being represented by a plurality of intermediate order bits and higher order bits for storing color data of the foreground of the display, and a plurality of lower order bits for storing anti-aliased intensity data which modifies the resulting pixel color appearing on the display to a value inclusively between said foreground and said implied background color individually for each pixel location within said display memory.

9. The computer generated graphic display system as recited in claim 2 wherein the raster scan graphic display has an implied background color and further comprising display memory means for storing display data corresponding to each pixel location of the graphic display, with each pixel location being represented by a plurality of intermediate order bits and higher order bits for storing color data of the background of the display, and a plurality of lower order bits for storing anti-aliased intensity data which modifies the resulting pixel color appearing on the display to a value inclusively between said foreground and said implied background color individually for each pixel location within said display memory.

10. In a graphic display system of the type which includes a computer and which generates anti-aliased image display data for display on a raster scan graphic display and which includes a color look-up table for storing data representative of a plurality of predetermined colors, the improvement comprising gamma correction means for generating, for each predetermined color, data representing a plurality of gamma-corrected intensities and wherein said color look-up table includes an eight bit color map, three bits of which store antialiasing information and the remaining, higher order five bits store thirty two predefined colors and wherein the color look-up table further stores, for each of these colors, eight gamma corrected intensities calculated by adding the three bit intensity value to the five upper bit color values to form an eight bit color map entry number wherein said gamma correction is applied selectively to the intermediate color values between foreground and background while leaving all other image data uncorrected which effectively smooths vectors on a raster scan graphic display without affecting any other photometric property of the display apparatus.

11. The graphic display system as recited in claim 10 wherein the computer, in performing a vector draw display, logically shifts a five-bit color value three bits to the left to place the color value in the high order position of an eight-bit pixel value then combines said pixel value with a three bit intensity value, calculated according to a predetermined anti-aliasing algorithm using an inclusive OR logical operation, which places the intensity data in the low order position of the eight bit pixel value, whereby a multicolor anti-aliased vector on a black background can be displayed.

12. The graphic display system as recited in claim 10 wherein the computer, in performing a vector draw display, first sets the display background to a desired color, sets a software flag indicating that inverse video vectors are to be drawn, calculates the three bit pixel intensity value according to a predetermined anti-aliasing algorithm to produce an anti-aliasing pixel intensity value and exclusive OR's said anti-aliasing pixel intensity value with a predetermined digital value representing full intensity whereby the anti-aliasing intensity value is altered to produce the required intermediate color values to apply the anti-aliasing effect to an inverse video vector.

13. A method of using a digital computer to define anti-aliased, gamma corrected colors for use in displaying color vectors on a raster scan graphic display comprising the steps of defining the red, green, and blue intensities for the foreground and the background of each of the vector colors, calculating an array of gamma-corrected color intensities, storing the array of gamma-corrected color intensities in a look-up table in a digital memory, calculating eight linear intensity values as even increments from foreground to background for each red, green and blue component of each vector color, using the linear intensity values as a subscript into the look-up table to find the corresponding gamma-corrected value for that color intensity, and storing that color intensity in a color look-up table, wherein said plurality of intensities are located within the color look-up table as a function of the anti-aliasing value corresponding to the calculated intensity value, and storing anti-aliased, display image data in a bit mapped memory for a raster scan display screen, reading the display data out of the bit mapped memory and feeding the data into the color look-up table to produce gamma-corrected display image data, such that a linear relationship exists between successive anti-aliasing values and successive intermediated colors progressing from background to foreground as the colors appear on a raster scan graphic display, whereby independence between anti-aliased foreground image data and existing background image data is facilitated.

14. The method as recited in claim 13, further comprising the steps of exchanging the foreground color with that of the background color in reading the color look-up table to enable inverse video display of a given color vector.

15. The method as recited in claim 13, wherein the steps of storing the anti-aliased, display image data in the bit mapped memory comprises the further steps of storing display data corresponding to each pixel location of the graphic display, with each pixel location being represented by a plurality of intermediate order bits for storing the color data of the foreground of the display, a plurality of higher order bits for storing color data of the background of the display, and a plurality of lower order bits for storing anti-aliased intensity data which modifies the resulting pixel color appearing on the display to a value inclusively between said foreground and said background color values individually for each pixel location within said display memory.

16. The method as recited in claim 15, wherein changing the display image data stored in the bit mapped memory comprises writing new anti-aliased display data in the bit mapped memory while simultaneously masking the plurality of higher order bits to protect the existing background information.

17. The method as recited in claim 15, wherein changing the display image data stored in the bit mapped memory comprises writing new anti-aliased display data in the bit mapped memory while simultaneously masking the plurality of intermediate order bits to protect the existing foreground information.

18. The method as recited in claim 15, wherein changing the display image data stored in the bit mapped memory comprises writing new anti-aliased display data in the bit mapped memory while simultaneously masking the plurality of intermediate and higher order bits to allow an anti-aliased line to be erased cleanly with full restoration of the previous background.

* * * * *